US006059420A

United States Patent [19]

Rogers

[11] Patent Number: 6,059,420

[45] Date of Patent: May 9, 2000

[54] SEE THROUGH REFRIGERATOR DOOR CONSTRUCTION

[76] Inventor: Thomas Rogers, 833 Wilde Ave., Drexel Hill, Pa. 19026

[21] Appl. No.: 09/251,677

[22] Filed: Feb. 17, 1999

[51] Int. Cl.[7] ..... F21W 131/305

[52] U.S. Cl. ..... 362/92; 362/94; 362/223; 362/251; 362/802

[58] Field of Search ..... 362/92, 94, 31, 362/559, 560, 251, 249, 253, 802, 223, 224, 225

[56] References Cited

U.S. PATENT DOCUMENTS

| | | | |
|---|---|---|---|
| 2,279,558 | 4/1942 | Clerc | 62/89.5 |
| 4,072,486 | 2/1978 | Joseph | 62/131 |
| 4,475,031 | 10/1984 | Mockovciak, Jr. | 250/212 |
| 5,016,146 | 5/1991 | Kaspar | 362/92 |
| 5,287,252 | 2/1994 | Caruso | 362/92 |
| 5,471,372 | 11/1995 | Mamelson et al. | 362/92 |
| 5,589,958 | 12/1996 | Lieb | 349/16 |
| 5,909,950 | 6/1999 | Seok et al. | 362/92 X |

*Primary Examiner*—Laura K. Tso
*Attorney, Agent, or Firm*—Henderson & Sturm LLP

[57] ABSTRACT

A see through refrigerator door construction 10 for use on both the freezer section 102 and the refrigerator section 103 of a refrigerator 100. The door construction 10 includes a framework member 20 having an outer transparent pane 22 and an inner two way mirror pane 24 which is surrounded by an illumination unit 12 for projecting light into the interior of the refrigerator 100 to render the two way mirror pane 24 transparent in response to the actuation of a pressure switch 40.

6 Claims, 2 Drawing Sheets

SEE THROUGH REFRIGERATOR DOOR CONSTRUCTION

BACKGROUND OF THE INVENTION

1. Field of the Invention

The present invention relates to the field of specialized housings in general, and in particular to a see through refrigerator door construction which normally presents a mirrored reflection from the refrigerator door.

2. Description of Related Art

As can be seen by reference to the following U.S. Pat. Nos. 2,279,558; 4,072,486; 4,475,031; and 5,589,958, the prior art is replete with viewing windows having varying degrees of transparency for observing the contents of cupboards, room, refrigerators and ranges.

While all of the aforementioned prior art constructions are more than adequate for the basic purpose and function for which they have been specifically designed, they are almost uniformly deficient with respect to their failure to provide a simple, efficient, and practical selective see through viewing panel on a refrigerator to observe the contents of the refrigerator.

Furthermore, while U.S. Pat. Nos. 4,072,486, and 5,589,486 employ various degrees of opacity to obscure the contents of the refrigerator, these schemes do not produce the aesthetically pleasing and functional features that are to be found in the present invention.

In most modern kitchens, aesthetic considerations are of a primary concern as is the conservation of energy. Furthermore, given today's lifestyles, one of the last places that a person occupies for any appreciable amount of time before leaving a residence is the kitchen. Since most kitchens are not provided with mirrors, many people will make a last second detour to a room equipped with a mirror to check their appearance before departing. In the alternative, those same individuals will rely on a shiny or slightly reflective surface in the kitchen to save time; however, they can only rely on a distorted and/or weak reflected image to check their appearance.

As a consequence of the foregoing situation, there has existed a longstanding need for a new and improved type of see through refrigerator door construction which employs a one-way mirror panel such that the user can selectively employ the normal mirror image, except for those times when they wish to inspect the contents of the refrigerator before opening the refrigerator door, and the provision of such a construction is a stated objective of the present invention.

BRIEF SUMMARY OF THE INVENTION

Briefly stated, the see through refrigerator door construction that forms the basis of the present invention comprises in general, a door panel unit, an illumination unit, and an illumination control unit. The illumination unit completely contained within the door panel unit and adapted to convert the door panel unit from a mirrored finish to a virtually transparent finish.

As will be explained in greater detail further on in the specification, the door panel unit includes an outer framework member provided with an outer transparent pane and an inner two way mirror pane. The inner two way mirror pane is surrounded by a peripheral groove.

In addition, the illumination unit comprises a light source including a plurality of high intensity lights which are disposed within the peripheral groove in the framework member and controlled by the illumination control unit which comprises a pressure sensitive switch mounted between the transparent pane and the two way mirror pane and a kill switch member which is disposed in an overriding relationship relative to the pressure switch member.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
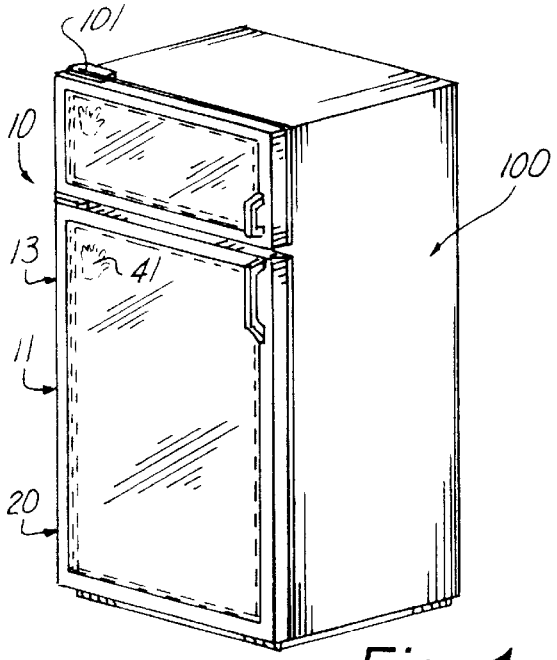
FIG. 1 is a perspective view of a refrigerator equipped with the see through refrigerator door construction of this invention.
Figure 4:
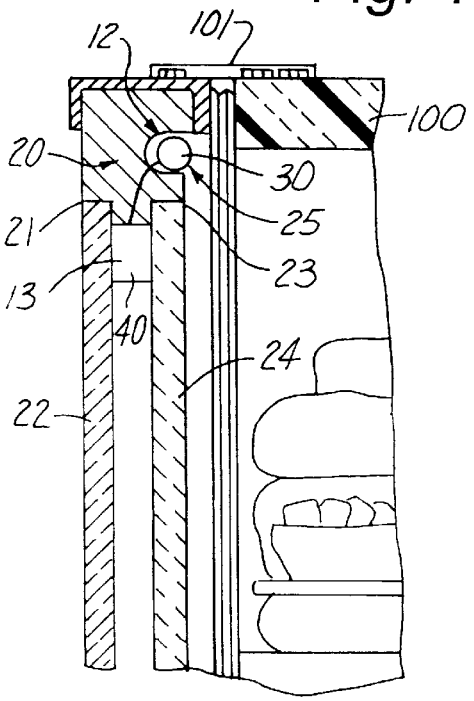
FIG. 4 is a cross sectional detail view of the various components that comprise the see through refrigerator door construction.

As can be seen by reference to the drawings, and in particular to FIG. 1, the see through refrigerator door construction that forms the basis of the present invention is designated generally by the reference number 10. As shown in FIG. 4, the construction 10 comprises a door panel unit 11, an illumination unit 12, and a control unit 13. These units will now be described in seriatim fashion.

As shown in FIGS. 1 and 4, the door panel unit 11 comprises a generally open rectangular door framework member 20 having an outer internal peripheral recess 21 dimensioned to receive a transparent panel 22, an inner internal peripheral recess 23 dimensioned to receive a two-way mirror panel 24 and an internal peripheral groove 25 disposed in a surrounding relationship with the two way mirror panel, and dimensioned to receive the illumination unit 12.

In addition, the door framework member 20 is further operatively attached in a conventional manner to the main body of the refrigerator 100 by hinge elements 101 disposed on the upper and lower ends of one side of the door framework member.

As can best be seen by reference to FIG. 4, the illumination unit 12 comprises a light source including a plurality of high intensity lights 30 which are disposed around the interior periphery of the framework member 20 and dimensioned to be received in the internal peripheral groove 25 in the door framework member 20 in a surrounding relationship to the two way mirror panel 24 to project light into the interior of the refrigerator 100.

Figure 2:
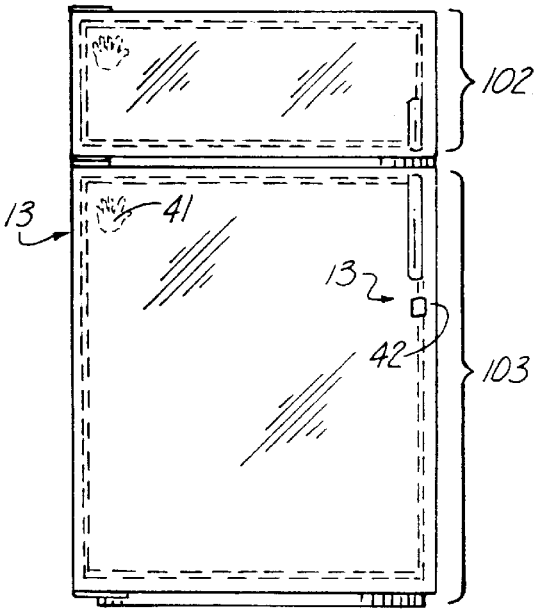
FIG. 2 is a front plan view of the refrigerator door construction in the mirrored surface mode.
Figure 3:
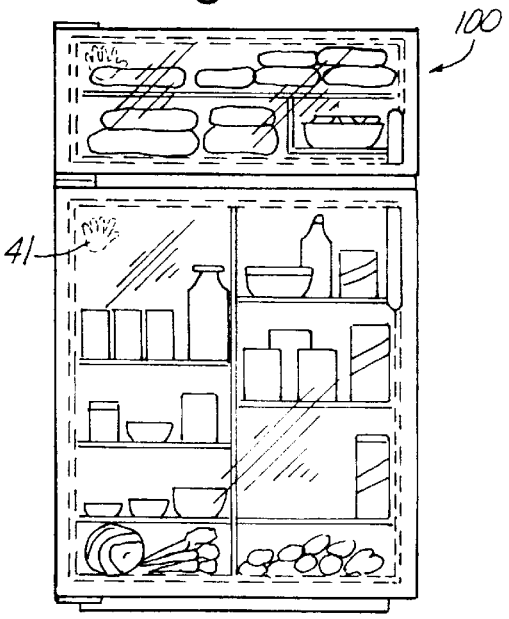
FIG. 3 is a front plan view of the refrigerator door construction in the transparent mode.
Figure 5:
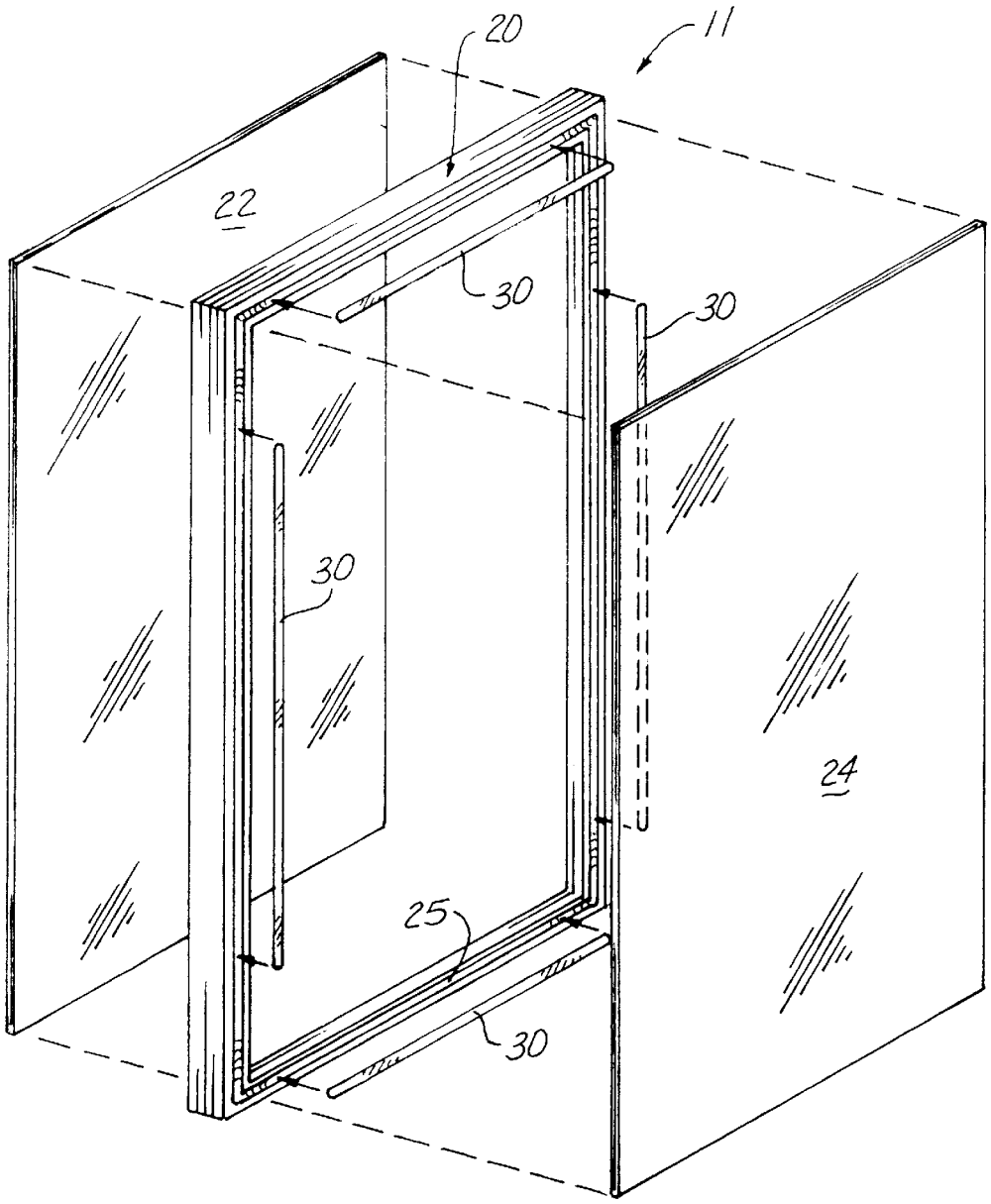
FIG. 5 is an exploded perspective view of the construction as seen from the interior of the refrigerator.

Turning now to FIGS. 1, 2, and 4, it can be seen that the illumination control unit 13 comprises one or more pressure sensitive switch members 40 disposed at a location proximate the corners of the outer transparent panel 22. The location of the pressure switch member 40 may be generally designated by a small hand shaped imprint 41 formed on or applied to the outer surface of the transparent panel 22 so that the user will be given a visual indication of where to press on the transparent panel 22 to activate the illumination unit 12 to render the two way mirror panel transparent as depicted in FIG. 3.

Furthermore, as depicted in FIG. 2, the illumination control unit 13 may also include a kill switch member 42 which is electronically connected to the pressure switches 40 to render the illumination unit 12 inoperative until its actuation as desired by an adult. This feature is provided for those instances where small children may be tempted to repeatedly actuate the pressure sensitive switch 40 due to the novelty of the contents of the refrigerator "magically" becoming visible through the two way mirror panel 24.

The adult users of this construction will however appreciate the convenience of having a mirror in the kitchen which may selectively be rendered transparent so that the adult can view the contents of the interior of the refrigerator without the necessity of opening up the refrigerator door.

As can also be appreciated by reference to FIG. 2, the door construction 10 can be employed for both the freezer section 102 and the refrigerator section 103 of the refrigerator 100.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A see through refrigerator door construction comprising:

a door panel unit including an opera rectangular shaped door framework member having an outer internal peripheral recess dimensioned to receive a transparent panel, an inner internal peripheral recess dimensioned to receive a two-way mirror panel and an internal peripheral groove disposed in a surrounding relationship with said inner internal peripheral recess;

an illumination unit dimensioned to be received in said internal peripheral groove; and an illumination control unit including a first switch member disposed in a controlling fashion relative to said illumination unit.

2. The door construction as in claim 1 wherein said illumination unit comprises a light source dimensioned to be received in said internal peripheral groove.

3. The door construction as in claim 2 wherein said light source comprises a plurality of high intensity lights disposed in said peripheral groove.

4. The door construction as in claim 3 wherein said first switch member comprises a pressure sensitive switch.

5. The door construction as in claim 4 wherein said pressure sensitive switch is disposed intermediate the transparent panel and the two way mirror panel.

6. The door construction as in claim 5 wherein said illumination control unit further includes a second switch member disposed in a controlling relationship relative to said first switch member.

* * * * *